United States Patent [19]

Tamura et al.

[11] 4,372,765

[45] Feb. 8, 1983

[54] AIR LIQUEFACTION AND SEPARATION PROCESS AND EQUIPMENT

[75] Inventors: Shoichi Tamura, Kobe; Takayoshi Asami, Ohtsu; Hidekazu Sonoi, Kobe, all of Japan

[73] Assignee: Kabushiki Kaisha Kobe Seiko Sho, Kobe, Japan

[21] Appl. No.: 238,206

[22] Filed: Feb. 26, 1981

[30] Foreign Application Priority Data

Feb. 26, 1980 [JP] Japan ..... 55-23813

[51] Int. Cl.[3] ..... F25J 3/04

[52] U.S. Cl. ..... 62/29; 62/42

[58] Field of Search ..... 62/29, 30, 42, 24

[56] References Cited

U.S. PATENT DOCUMENTS

| | | | |
|---|---|---|---|
| 1,363,659 | 12/1920 | Lachmann | 62/29 |
| 1,784,120 | 12/1930 | Van Nuys et al. | 62/30 |
| 1,945,367 | 1/1934 | Gobert | 62/29 |
| 2,502,250 | 3/1950 | Dennis . | |
| 2,513,306 | 7/1950 | Garbo | 62/29 |
| 3,754,406 | 8/1973 | Allam | 62/29 |

OTHER PUBLICATIONS

Chemie Ingenieur Technik by Helmut Springmann, Chemie-Ing.-Techn, vol. 46, 1st Edition, Nov. 1974, No. 21, pp. 881-924.

*Primary Examiner*—Norman Yudkoff

*Attorney, Agent, or Firm*—Oblon, Fisher, Spivak, McClelland & Maier

[57] ABSTRACT

A method and equipment are disclosed herein which liquefy and separate air through the use of a multiple rectifying tower system comprising a high pressure tower and a low pressure tower. The rectifying regions of the high pressure tower and the low pressure tower are divided into an equal number (at least two) of segments and gases at the tops of the respective segments of the high pressure tower are permitted to exchange heat with circulating liquids or liquid oxygen at the bottoms of the respective segments of the low pressure tower and to evaporate the circulating liquids or the liquid oxygen. The gases are then condensed to provide a circulating liquid for the low pressure tower.

3 Claims, 6 Drawing Figures

AIR LIQUEFACTION AND SEPARATION PROCESS AND EQUIPMENT

BACKGROUND OF THE INVENTION

1. Field of the Invention

This invention relates to an air liquefaction and separation process and equipment, and more particularly to a method and equipment by which liquefied air is purified and separated at a pressure significantly lower than the source air pressure in the recently prevailing overall low pressure air liquefaction and separation method.

2. Description of the Prior Art

Since the advent of the air liquefication and separation method investigations of purification and separation have been directed toward energy saving in purifying and separating products. Typical examples of those investigations include improvements in process for minimizing the amount of residual air for ensuring coldness necessary for liquefaction and separation of air, improvements in rectifying towers for ensuring a higher yield of products and reducing energy necessary for purification and separation and improvements by which to enhance operating efficiencies of various machines and components in separators. As a result, the air liquefaction and separation equipment has undergone changes from the early type wherein a pre-cooling auxiliary air system with about 200 Kg/cm$^2$G of pressure is incorporated into an air system with about 5 Kg/cm$^2$G of source air pressure to the overall low pressure type wherein no auxiliary air system is required through the low pressure type wherein an auxiliary air system of about 10 Kg/cm$^2$G pressure is employed. The latest overall low pressure type air liquefaction and separation equipment is constructed as shown in FIG. 1. Having compressed to about 5 Kg/cm$^2$G and cooled to approximately its liquefying point, source air is fed through a passage 1 to a lower tower 3 (high pressure tower) in a multiple rectifying tower 2. While traveling upward within the lower tower 3, the source air conducts exchange of substance with liquefied nitrogen flowing from an evaporator 4. The circulating liquid bears highly purified nitrogen and exhibits an increase in oxygen content, respectively, when traveling upward and downward in the tower. Accordingly, the liquefied air containing high density oxygen at the bottom of the lower tower 3 is fed to an upper tower 7 (low pressure tower) through a passage 5 and an expansion valve 6. Nitrogen gas moving upward along the lower tower 3 exchanges heat with liquid oxygen resting on the bottom of the upper tower 7, evaporating the liquid oxygen and condensing by itself. The resultant liquefied nitrogen is supplied as circulating liquid nitrogen to the lower tower 3 with the part thereof being directed to the upper tower 7 via a passage 8 and an expansion valve 9. The source material supplied to the upper tower 7 is then separated into nitrogen and oxygen through rectification with product nitrogen discharged via the top of the upper tower and product oxygen being discharged via the bottom thereof through passages 10 and 11, respectively. In FIG. 1, an impure nitrogen drain is labeled 12.

The overall low pressure air liquefaction and separation method has been well advanced thanks to a highly efficient multiple rectifying tower system to the extent that it can almost completely rectify and separate oxygen and nitrogen. Furthermore, an attempt to reduce power conventional units by meamns of an improvement in providing coldness has attained its maximum through the utilization of a reactionary expansion turbine, etc. More advanced energy-saving purification and separation seems impossible or impractical without a drastic innovation introduced in connection with separation technique.

With ever-increasing demand for oxygen and in view of a resource-saving requirement, energy necessary for separation and purification should be as low as possible. The present-day overall low pressure air liquefaction and separation process, however, appears to be a way to attain a high yield with the highest reliability and is not expected to decrease an electrical energy requirement for purification and separation to a minimum (typically, below 0.45–0.47 KWH/Nm$^3$ in connection with high purity oxygen) no matter how a large-sized system is designed. Lowering the pressure of the source air is deemed as an effective and practical approach to reduce energy consumption due to the historical fact that the pressure of an auxiliary system has been gradually decreased. Since a differential pressure between the lower tower (say, 4.5–5.0 Kg/cm$^2$G) and the upper tower (say, 0.2–0.45 Kg/cm$^2$G) of the multiple rectifying tower system insures a differential temperature of about 1°–3° C. necessary for evaporating the liquefied oxygen at the bottom of the upper tower and condensing the gaseous nitrogen at the top of the lower tower, an attempt to decrease the pressure of the lower tower results in decreasing the internal temperature of the lower tower and failing to insure the differential temperature between the top of the lower tower and the bottom of the upper tower. However a high performance evaporator is designed and manufactured, it is essentially impossible to decrease the pressure of the source air below about 5 Kg/cm$^2$G and save energy for purification and separation.

SUMMARY OF THE INVENTION

With the foregoing in mind, it is an object of the present invention to provide an improve air liquefaction and separation process and equipment which is operable at a pressure of source air lower than the limit (typically, 4.5–5 Kg/cm$^2$G) of source air pressure in the overall low pressure system air liquefaction and separation technique and at a minimum of energy for purifying and separating liquid air.

According to the present invention, there is provided an air liquefaction and separation process which uses a multiple rectifying tower system including a high pressure tower and a low pressure tower with the rectifying regions of the two towers being divided into an identical number (at least two) of working segments or heat transfer regions. Gases at the tops of the respective working segments of the high pressure tower are permitted to exchange heat with circulating liquids or liquid oxygen at the bottoms of the corresponding segments of the low pressure tower, thus evaporating the circulating liquids or liquid oxygen. The gases then become condensed and travel as a circulating liquid in the low pressure tower.

In other words, the process according to the preset invention allows the heat exchange regions to extend to the region from the top to the bottom of the high pressure tower as well as to the that from the bottom to the top of the low pressure tower and heat exchange to take place at at least the two regions under different conditions differently from the prior art wherein heat exchange is conducted at a single region and under a single condition, in order to insure a differential temperature necessary for heat exchange between the condensing temperature of gaseous nitrogen at the top of the high pressure tower and the boiling temperature of the liquid oxygen at the bottom of the low pressure tower and ensure rectification in the air separator system even when the system is operated at a pressure lower than the operating pressure of the lower tower (high pressure tower) in the prior art overall low pressure air liquefying and separating system.

BRIEF DESCRIPTION OF THE DRAWINGS

Various other objects, features and attendant advantages of the present invention will be more fully appreciated as the same becomes better understood from the following detailed description when considered in connection with the accompanying drawings in which like reference characters designate like or corresponding parts through the several views and wherein.

DETAILED DESCRIPTION OF THE PREFERRED EMBODIMENT

Figure 1:
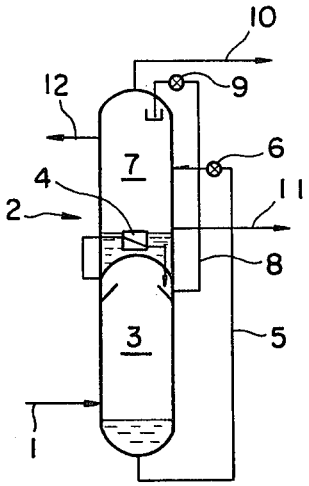
FIG. 1 is a schematic diagram of the prior art liquefaction and separation equipment.
Figure 2:
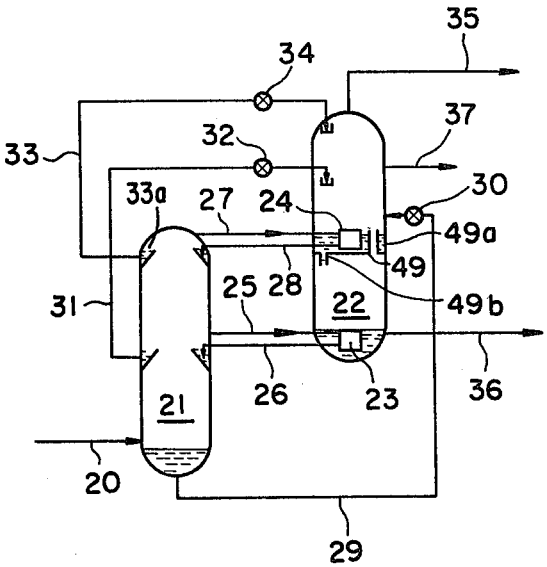
FIG. 2 is a schematic diagram of an air liquefaction and separation equipment constructed according to the present invention.
Figure 3:
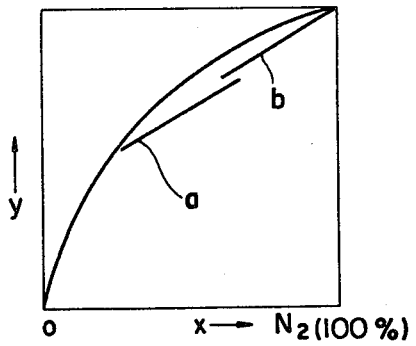
FIGS. 3 and 4 are graphs showing operations of high pressure and low pressure towers in the equipment of FIG. 2.
Figure 4:
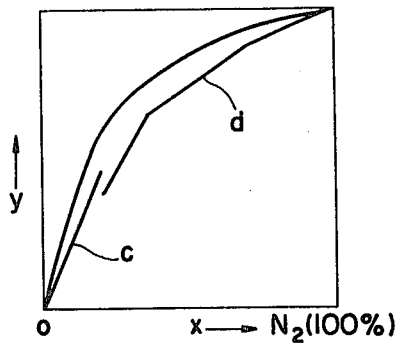

Referring now to FIG. 2, there is illustrated air liquefaction and separation equipment according to the present invention, which includes a rectifying tower system of a high pressure tower 21 and a low pressure tower 22 indenpendent of the high pressure tower. The low pressure tower 22 is provided at the bottom and intermediate portion thereof with evaporators 23 and 24, respectively, with the former 23 in communication with the intermediate portion of the high pressure tower 21 via passages 25 and 26 and the latter 24 in communication to the top of the high pressure tower. To maintain the evaporator 24 in contacting relationship with circulating liquids flowing through the intermediate portion of the low pressure tower 22, a partition 49 having a conduit 49*a* for ascending steam and a conduit 49*b* for descending circulating liquids is provided to define a reservoir with an evaporator 24 disposed therein for receiving the circulating liquids. Provided that the evaporators 23 and 24 are respectively disposed at the bottom and intermediate portion of the low pressure tower (in other words, the respective bottoms of the lower and upper regions of the low pressure tower) and connected to the intermediate portion and top of the high pressure tower in this manner, the rectifying regions of the high and low pressure towers are divided into two segments. It is clear from FIG. 3 showing in equilibrium diagram substance balance in operation of the high pressure tower that the working region of the high pressure tower is divided into a first segment extending from the bottom to the intermediate portion of the high pressure tower as depicted by the straight line a and a second segment extending from the intermediate portion to the bottom of the high pressure tower as depicted by the straight line b. Similarly, the working region of the low pressure tower, as shown in FIG. 4, is classified into a first segment extending from the bottom to the intermediate portion (below the evaporator 24) of the low pressure tower as defined by the straight line c and a second segment extending from the intermediate portion (where the evaporator 24 is disposed) to the top of the low pressure tower. Rectification is performed with the above described rectifying tower system in the following manner. After being condensed and cooled to approximately its liquefying point in a well-known method, the source air enters the high pressure tower 21 via a passage 20 and exchanges substance with the circulating liquid nitrogen to separate into high purity nitrogen at the top of the tower and liquid air containing high density oxygen at its bottom while moving upward within the high pressure tower 21. The liquid air at the bottom of the high pressure tower is furnished to the intermediate portion of the low pressure tower 22 via a passage 29 and an expansion valve 30 and rectified and separated in the low pressure tower into nitrogen gas at its top and liquid oxygen at its bottom. Part of the source air moving upward in the high pressure tower 21 enters into the evaporator 23 through a passage 25 connected to the intermediate portion thereof to conduct heat exchange with the liquid oxygen at the bottom of the low pressure tower 22, evaporating the liquid oxygen. As a result, the source air partly becomes condensed and liquefied with a part thereof being supplied as a circulating liquid to the intermediate portion of the high pressure tower via a passage 26 and a remaining part thereof being fed to the intermediate portion of the low pressure tower 22 via a passage 31 and an expansion valve 32. The nitrogen gas at the top of the high pressure tower 21, on the other hand, enters into the evaporator 24 at the intermediate portion of the low pressure tower 21 via the passage 27 and conducts heat exchange with the circulating liquid moving downward across the intermediate portion of the low pressure tower 22, evaporating part of that circulating liquid. Under these circumstances, the nitrogen gas becomes condensed and a part of the condensed nitrogen gas is fed as circulating liquid nitrogen to the top of the high pressure tower 21 at 33*a* via the passage 28 and a remaining part thereof is fed as circulating liquid nitrogen to the top of the low pressure tower 22 via an expansion valve 34. The nitrogen gas and the liquid nitrogen or gaseous oxygen purified and separated at the top and bottom of the low pressure tower are discharged outside the tower system via passages 35 and 36, while impure nitrogen gas at the intermediate portion of the low pressure tower is discharged outside the tower system via a passage 37.

Assuming the pressure of the source air is 4.0 $Kg/cm^2G$ and the operating pressure of the low pressure tower is 0.4 $Kg/cm^2G$ during rectifying operation, the temperature distribution of the high pressure tower 21 covers from—175° C. at its bottom to—179° C., while that of the low pressure tower 22 covers from—179° C. at its bottom to—193° C. at its top. Through heat exchange between the nitrogen gas at the top of the high pressure tower and the circulating liquids at the intermediate portion of the low pressure and that between the liquid oxygen at the bottom of the low pressure tower and the ascending gases at the intermediate portion of the high pressure tower, there is developed a differential temperature necessary for evaporating the liquid oxygen at the bottom of the low pressure tower and condensing the nitrogen gas at the top of the high pressure tower, which temperature makes it possible to effect rectification at a low pressure at which the prior art overall low pressure process was inoperable.

Whereas in the illustrated embodiment the working regions of the high pressure and low pressure towers are split into the two segments and the evaporators are disposed at the bottoms of the respective segments of the low pressure tower to effect heat exchange between the gases at the tops of the respective segments of the high pressure tower and the circulating liquids and the liquid oxygen at the bottoms of the respective segments of the low pressure tower, generating steam and the circulating liquids necessary for rectification, it is obvious that the working regions of the high pressure and low pressure towers may be divided into more than two segments to effect rectification. Furthermore, the high pressure and low pressure towers may be of a multi-story structure with a mimimum space as shown in FIG. 5 though both as shown as being discrete in the above example.

Figure 5:
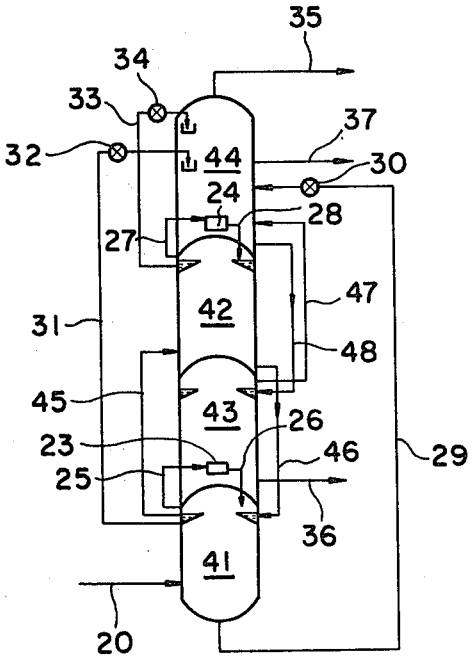
FIG. 5 is a schematic diagram of a modification in the equipment of FIG. 2.

The rectifying tower system of FIG. 5 is a modification in the tower system of FIG. 2 into the multi-story structure wherein four tower blocks, that is, a first high pressure tower 41, a second high pressure tower 42, a first low pressure tower 43 and a second low pressure tower 44, all of which are stacked as a single structure. This structure is similar to that of FIG. 2 as to arrangement and rectification operation except the following aspects. The first high pressure tower 41 is in communication with the second high pressure tower 42 via a passage 45 leading the steam from the top of the former 41 to the bottom of the latter 42 and a passage 46 leading the circulating liquids from the bottom of the latter 42 to the top of the former 41. The first low pressure tower 43 is communicated with the second low pressure tower 44 via a passage 47 leading the steam from the top of the former 43 to the bottom of the latter 44 and a passage 48 leading the circulating liquids from the bottom of the latter 44 to the top of the former 43.

It is understood that in the above example the evaporator disposed at the bottoms of the respective segments of the low pressure tower serve as the proper vehicle of heat exchange for generating the steam and the circulating liquids necessary for rectification. However, the vehicle of heat exchange should not be limited to those evaporators and may be condensors disposed at the tops of the respective segments of the high pressure tower and connected to the bottoms of the corresponding segments of the low pressure tower through passages. As an alternative, the bottoms of the respective segments of the low pressure tower are connected to the tops of the corresponding segments of the high pressure tower via heat exchangers.

Figure 6:
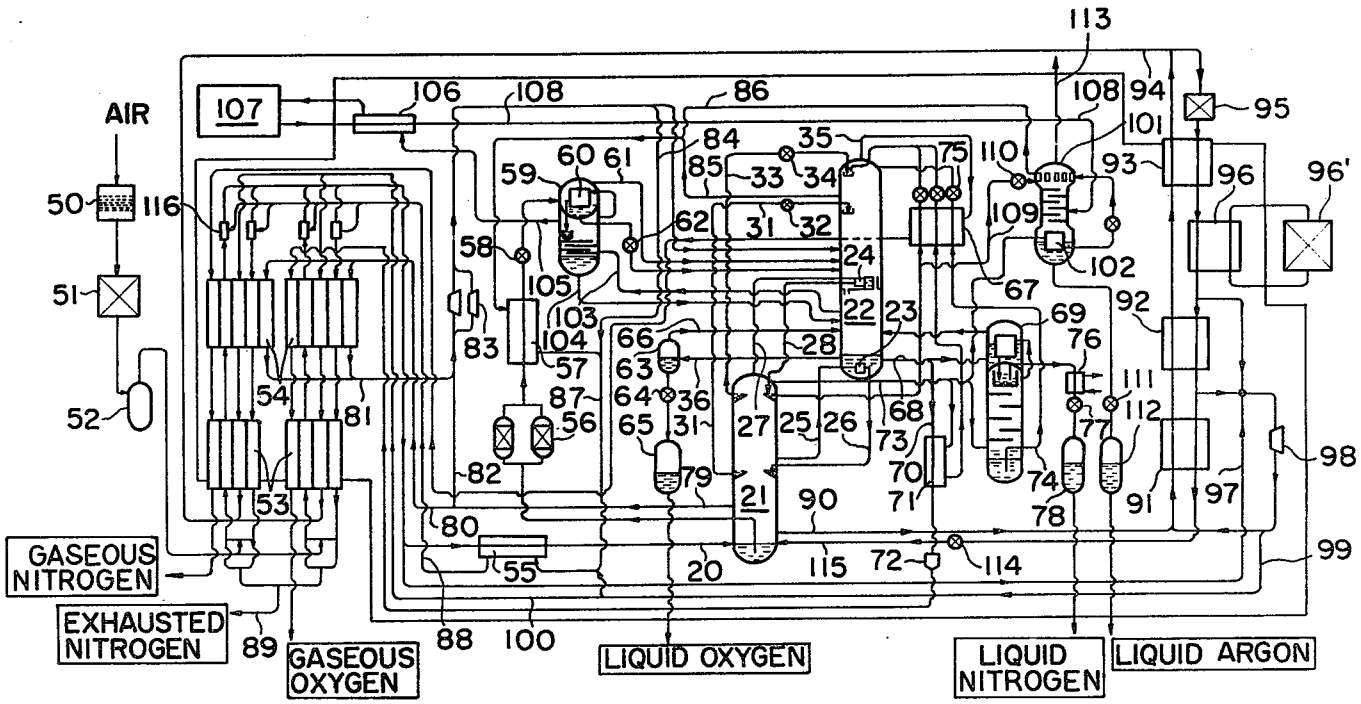
FIG. 6 is a systematic diagram of the air liquefaction and separation equipment according to the present inventioin.

FIG. 6 is a systematic diagram of a low pressure type air liquefaction and separation equipment with an added argon separator according to the present invention. This system is adapted to generate gaseous oxygen, liquid oxygen, gaseous nitrogen, liquid nitrogen and liquid argon at the same time. Operation of the equipment will be described below. After being rid of dust via an air filter 50, the source air is compressed up to about 4 $Kg/cm^2G$ by an air compressor 51. Furthermore, after water is removed from the source air, the source air is cooled to approximately its liquefying point via high temperature and low temperature regions 53 and 54 of a reversing heat exchanger, a follower valve casing 116 and an air cooler 55 and supplied to the high pressure tower 21 of the multiple rectifying tower system. Rectification takes place so that high purity nitrogen is developed at the top of the high pressure tower and liquid air containing high density oxygen is developed at its bottom. The liquid air at the bottom of the high pressure tower is supplied through a liquid air filter 56, a liquid air cooler 57 and an expansion valve 58 to the top of a crude argon tower 59 wherein the liquid air condenses the gas entering a condenser 60 and evaporates by itself. The resulting steam is introduced into the low pressure tower 22 at about 0.2–0.45 $Kg/cm^2G$ via a passage 61, whereas the remaining liquid is supplied via an adjustment valve 62 to the intermediate portion of the low pressure tower 22. As stated previously, the high purity nitrogen gas is rectified and separated onto the top of the low pressure tower 22 and the high purity liquid oxygen onto the bottom of the low pressure tower 22. The high purity nitrogen gas at the top is led via the passage 35 and a liquid nitrogen cooler 67 and then warmed up to room temperature via the low temperature and high temperature regions 54 and 53 of the reversing heat exchanger 54, thus finally delivering product nitrogen gas outside the tower system. On the other hand, the liquid oxygen accumulated on the bottom is collected as a product into a liquid oxygen tank or the like through the passage 36, a bubble separator 63, an expansion valve 64 and a liquid oxygen measuring tank 65. Gases separated from the liquid oxygen through the bubble separator 63 are returned to the bottom of the low pressure tower via a passage 66.

To re-boil the liquid oxygen at the bottom of the low pressure tower 22 (the bottom of the lower region of low pressure tower), part of the source air is extracted from the intermediate portion of the high pressure tower 21 (the top of the lower region of the high pressure tower) through the passage 25 and led to the evaporator 23 disposed on the bottom of the low pressure tower 22 (the bottom of the lower region of the low pressure tower). Developed within the evaporator 23 is heat exchange between the source air and the liquid oxygen so that the source air is condensed itself and fed as a circulating liquid back to the intermediate portion of the high pressure tower 21 via the passage 26 while re-boiling the liquid oxygen. Part of the source air is also fed as a circulating liquid from the passage 31 to the intermediate portion of the low pressure tower (the intermediate portion of the upper region of the low pressure tower) via the expansion valve 32. The nitrogen gas traveling from the top of the high pressure tower 21 (the top of the upper region of the high pressure tower) via the passage 27 is introduced into the evaporator 24 disposed at the intermediate portion of the low pressure tower 22 (the bottom of the upper region of the low pressure tower. The nitrogen gas exchanges heat with the circulating liquids in that evaporator 24 and becomes condensed itself while reboiling the circulating liquids. Thereafter, the nitrogen gas is returned as the circulating liquid nitrogen to the high pressure tower 21 by way of the passage 28 with its portion being supplied as the circulating liquid nitrogen from the passage 33 to the top of the low pressure tower 22 through the expansion valve 34.

Part of the liquid oxygen resting on the bottom of the low pressure tower 22 is further divided into two portions via a passage 68 with one being fed to the top of an auxiliary nitrogen rectifying tower 69 and the other being led from a passage 70 via an auxiliary evaporator 71 and an acetylene separator 72 to the low temperature and high temperature regions 54 and 53 of the reversing heat exchanger wherein that portion of the liquid oxygen is heated up to room temperature and delivered as product gas oxygen outside the tower system. Part of the nitrogen gas resting on the top of the high pressure tower 21, on the other hand, is also divided into two portions by way of a passage 73 with one being fed to an argon reboiling evaporator 102 disposed at the bottom of an argon rectifying tower 101 and the other being fed as raw material to a lower portion of the auxiliary nitrogen rectifying tower 69 wherein the nitrogen gas is rectified and separated into liquid nitrogen at the bottom of the auxiliary nitrogen rectifying tower 69 and high purity nitrogen gas at its top. While the liquid nitrogen at the bottom of the lower portion of the auxiliary nitrogen rectifying tower 69 is furnished to from a passage 74 to the top of the low pressure tower 22 via an expansion valve 75, the high purity nitrogen gas at the top of the lower portion of the auxiliary nitrogen rectifying tower 69 becomes condensed through heat exchange with the liquid oxygen furnished from the bottom of the low pressure tower 22 via the passage 68. The high purity nitrogen gas is then returned as a circulating liquid to the lower portion of the auxiliary rectifying tower with its portion being discharged as product liquid nitrogen outside the tower system through a nitrogen supercooler 76, an expansion valve 77 and a measuring tank 78. It is noted that oxygen being evaporated at the upper portion of the auxiliary nitrogen rectifying tower 69 is returned to the bottom of the low pressure tower 22.

Part of the source air is extracted as a circulating air necessary for the circulating system from the intermediate portion of the high pressure tower 21 via a passage 79 with its portion being led to the low temperature region 54 of the reversing heat exchanger via a passage 80 to cool the source air and its remaining portion flowing from the passage 79 to a passage 82 and entering into a low pressure expansion turbine 83 after merging into the first named portion. Adiabatic expansion takes place reversibly in the expansion turbine 83 so that the air is cooled to provide cooling necessary for the system and then divided into two portions. One of the two portions is fed to the intermediate portion of the low pressure tower 22 via the passage 84 and the other portion is mixed with impure nitrogen extracted from the intermediate portion of the low pressure tower 22 via a passage 85 and the nitrogen flowing from the cooler at the top of the argon rectifying tower 101 via a passage 86 and then intermingled with impure nitrogen flowing from the liquid air cooler 57. At the beginning of operation the latter is further mixed into the air coming from an intermediate pressure expansion turbine 98 to be discussed below via a passage 99 to cool the source air at the air cooler 55 and discharged as exhaust nitrogen by way of the low temperature and high temperature regions 54 and 53 of the reversing heat exchanger and a passage 89. In addition, part of the source air is extracted from the bottom of the high pressure tower 21 via a passage 90 and mixed into gases circulating through a low temperature heat exchanger 91, a high temperature heat exchanger 92, a pre-cooler 93 and a passage 94. Thereafter, that portion of the source air is compressed in a circulating air compressor 95, cooled by heat exchange in the pre-cooler 93 and divided into further two portions through a freon cooler 96. One of these two portions is furhter branched into two portions through the high temperature heat exchanger 92 with one being returned as a gas-liquid mixture to the bottom of the high pressure tower 21 via the low temperature heat exchanger 91, a liquid air feed pipe 115 and an expansion valve 114. After the remaining portion of the source air through the freon cooler 96 and the remaining portion through the high temperature heat exchanger 92 are mixed with the air from a passage 97, they are admitted to the intermediate pressure expansion turbine 98 wherein reversible adiabatic expansion takes place to provide cooling necessary for the system. The resulting mixture is then divided into two portions with one being mixed into the circulating gas directing from the high pressure tower 21 toward the heat exchanger 91 via the passage 90 with the other being further divided through the passage 99 into a flow which is to be mixed into the air flowing from the passage 87 to the air cooler 55 at the beginning of operation and another flow which is to be fed from a passage 100 to the low temperature and high temperature regions 54 and 53 of the reversing heat exchanger, heated up to room temperature and returned to the circulating air compressor 95 via the passage 94. A freon refrigerator is labeled 96'.

As described above, the low pressure type air liquefaction and separation equipment is provided with the argon separator including the crude argon tower 59 and the argon rectifying tower 101 for the manufacture of liquid argon. In other words, distillated argon gas containing a high argon content and a low nitrogen content is derived from the bottom side of the intermediate portion of the low pressure tower 22 and supplied to the lower portion of the crude argon tower 59 for rectifying purposes. Liquid containing high density oxygen developing at the bottom of the crude argon tower 59 is fed back to the intermediate portion of the low pressure tower 22 via a passage 104. Crude argon gas developing at the top of the tower 59 is condensed in part by the latent heat of the evaporating liquid air and moved downward as a circulating fluid with the remaining portion thereof entering from a passage 105 through a crude argon heat exchanger 106 into an argon rectifier device 107 by which oxygen as an impurity is completely removed by adding hydrogen from outside. Thereafter, the crude argon gas is cooled by the crude argon cooler 106 and fed via a passage 108 to the argon rectifying tower 101 which receives the nitrogen gas fed from the top of the high pressure tower 21 via the passage 73 to the evaporator 102 and the mixed gas and liquid nitrogen fed as a circulating liquid fed from the high pressure tower 21 via a passage 109 and an expansion valve 110 to its top for re-boiling the liquid argon resting on the high pressure tower 21. Nitrogen and residual hydrogen are discharged from the top of the argon tower 101 via a passage 113, while product liquid argon of high purity is delivered from the bottom of the tower 101 via an expansion valve 111 and a measuring tank 112.

As stated previously, the present invention provides the air liquefaction and separation equipment wherein the interiors of the high pressure tower and low pressure tower are divided into an equal number of segments and the steam and the circulating liquids necessary for rectification are ensured with heat exchange between the gases at the tops of the respective segments of the high pressure tower and the circulating liquids or the liquid oxygen at the bottoms of the corresponding segments of the low pressure tower. Therefore, the present invention has remarkable advantages as follows over the prior art overall low pressure air liquefaction and separation process and equipment:

(1) The present invention greatly reduces the operating pressure of the high pressure tower and thus reduces original unit costs as compared with the prior art.

(2) Necessary pressure of the compressor is decreased and thus mechanical facilities are economical.

(3) Designing the high pressure vessels in the air liquefaction and separation equipment with a pressure lower than that of the prior art equipment is possible and economical. Although the necessary number of the rectifying towers in the story configuration slightly increases, the manufacturing cost of the equipment may be saved as a whole.

(4) With decreased electric energy requirement, it becomes possible to make inexpensive and high purity oxygen and expand the range of applications of the air liquefaction and separation equipment to chemical, metallurgical, hygienic and anti-pollution industries.

Obviously, numerous modifications and variations of the present invention are possible in light of the above teachings. It is to be understood, therefore, that within the scope of the appended claims, the invention may be practiced otherwise than as specifically described herein.

What is claimed as new and desired to be secured by Letters Patent of the United States is:

1. A method for liquefying and separating air through the use of a high pressure rectifying tower having lower, intermediate and upper heat transfer regions, a low pressure rectifying tower having lower, intermediate and upper heat transfer regions, a first evaporator disposed within said lower heat transfer region of said low pressure rectifying tower, a second evaporator disposed within said intermediate heat transfer region of said lower pressure rectifying tower, nitrogen gas and liquid nitrogen disposed within said upper heat transfer region of said high pressure rectifying tower and said low pressure rectifying tower, liquid oxygen contacting said first evaporator, liquid nitrogen contacting said second evaporator, and liquid air containing high density oxygen disposed within said lower heat transfer region of said high pressure reactifying tower, wherein said method comprises:

introducing source air into said lower heat transfer region of said high pressure rectifying tower;

channeling said source air upwards through said high pressure rectifying tower to form partially rectified air;

circulating said liquid nitrogen within said upper heat transfer region of said high pressure rectifying tower downwards so as to contact said source air throughout said high pressure rectifying tower such that said source air is separated to form said nitrogen gas disposed within said upper heat transfer region of said high pressure rectifying tower and said liquid air containing high density oxygen disposed within said lower heat transfer region of said high pressure rectifying tower;

channeling said liquid air within said lower heat transfer region of said high pressure rectifying tower to said intermediate heat transfer region of said low pressure rectifying tower;

rectifying and separating said liquid air within said intermediate heat transfer region of said low pressure rectifying tower into said nitrogen gas within said upper heat transfer region of said low pressure rectifying tower and into said liquid oxygen contacting said first evaporator within said lower heat transfer region of said low pressure rectifying tower;

communicating said partially rectified air from said intermediate heat transfer region of said high pressure rectifying tower with said first evaporator;

evaporating said liquid oxygen contacting said first evaporator with said source air;

condensing a portion of said source air within said first evaporator to form a first condensed air portion;

supplying a first part of said first condensed air portion to said intermediate heat transfer region of said high pressure rectifying tower;

supplying a second part of said first condensed air portion of said intermediate heat transfer region of said low pressure tower;

channeling said nitrogen gas, which has not traversed said first evaporator, within said upper heat transfer region of said high pressure rectifying tower into said second evaporator such that said first evaporator and said second evaporator are disposed within parallel flow paths;

condensing said nitrogen gas within said second evaporator to form liquid nitrogen;

channeling a first part of said liquid nitrogen within said second evaporator to said upper heat transfer region of said high pressure rectifying tower; and channeling a second part of said liquid nitrogen within said second evaporator to said upper heat transfer region of said low pressure rectifying tower.

2. An apparatus for liquefying and separating air comprising:

a high pressure rectifying tower having lower, intermediate and upper heat transfer regions;

a low pressure rectifying tower having lower, intermediate and upper heat transfer regions;

a first evaporator disposed within said lower heat transfer region of said low pressure rectifying tower;

a second evaporator disposed within said intermediate heat transfer region of said low pressure rectifying tower;

a nitrogen gas and liquid nitrogen disposed within said upper heat transfer region of said high pressure rectifying tower and said low pressure rectifying tower;

liquid oxygen contacting said first evaporator;

liquid nitrogen contacting said second evaporator;

liquid air containing high density oxygen disposed within said lower heat transfer region of said high pressure reactifying tower;

means for introducing source air into said lower heat transfer region of said high pressure rectifying tower;

means for channeling said source air upwards through said high pressure rectifying tower to form partially rectified air;

means for circulating said liquid nitrogen within said upper heat transfer region of said high pressure rectifying toward downwards so as to contact said source air throughout said high pressure rectifying tower such that said source air is separated to form said nitrogen gas disposed within said upper heat transfer region of said high pressure rectifying tower and said liquid air containing high density oxygen disposed within said lower heat transfer region of said high pressure rectifying tower;

means for channeling said liquid air within said lower heat transfer region of said high pressure rectifying tower to said intermediate heat transfer region of said low pressure rectifying tower;

means for rectifying and separating said liquid air within said intermediate heat transfer region of said low pressure rectifying tower into said nitrogen gas within said upper heat transfer region of said low pressure rectifying tower and into said liquid oxygen contacting said first evaporator within said lower heat transfer region of said low pressure rectifying tower;

means for communicating said partially rectified air from said intermediate heat transfer region of said high pressure rectifying tower with said first evaporator;

means for evaporating said liquid oxygen contacting said first evaporator with said source air and condensing a portion of said source air within said first evaporator to form a first condensed air portion;

means for supplying a first part of said first condensed air portion to said intermediate heat transfer region of said high pressure rectifying tower;

means for supplying a second part of said first condensed air portion to said intermediate heat transfer region of said low pressure rectifying tower;

means for channeling said nitrogen gas which has not traversed said first evaporator within said upper heat transfer region of said high pressure rectifying tower into said second evaporator such that said evaporator and said second evaporator are disposed within parallel flow paths;

means for condensing said nitrogen gas within said second evaporator to form liquid nitrogen;

means for channeling a first part of said liquid nitrogen within said second evaporator to said upper heat transfer region of said high pressure rectifying tower; and means for channeling a second part of said liquid nitrogen within said second evaporator to said upper heat transfer region of said low pressure rectifying tower.

3. An apparatus according to claim 2 further comprising:

a plurality of high pressure rectifying towers;

a plurality of low pressure rectifying towers equal in number to and operatively associated with said plurality of high pressure rectifying towers;

means for alternatively stacking each of said high pressure towers with each of said low pressure towers so as to form a single structure;

means for fluidly communicating an upper interior portion of each of said high pressure rectifying towers with a bottom interior portion of a next succeeding high pressure rectifying tower;

means for fluidly communicating an upper interior portion of each of said low pressure rectifying towers with an interior portion of a next succeeding low pressure rectifying tower; and an evaporator connecting said upper interior region of each of said plurality of high pressure rectifying towers to said bottom interior portion of each of said next succeeding high pressure rectifying tower.

* * * * *

UNITED STATES PATENT AND TRADEMARK OFFICE

CERTIFICATE OF CORRECTION

PATENT NO. : 4,372,765

DATED : February 8, 1983

INVENTOR(S) : SHOICHI TAMURA ET AL

It is certified that error appears in the above-identified patent and that said Letters Patent is hereby corrected as shown below:

In column 1, line 68, after "power" insert "in";

In column 1, line 68, delete "meamns" and insert therefor --means--;

In column 2, line 62, delete "preset" and insert therefor --present--;

In column 3, line 21, after "art" insert "air";

In column 3, line 33, delete "ventioin" and insert therefor --vention--;

In column 3, line 41, delete "indenpendent" and insert therefor --independent--;

In column 4, lines 59-60, delete "fro-m" and insert therefor --from--;

UNITED STATES PATENT AND TRADEMARK OFFICE

CERTIFICATE OF CORRECTION

PATENT NO. : 4,372,765

DATED : February 8, 1983

INVENTOR(S) : SHOICHI TAMURA ET AL

It is certified that error appears in the above-identified patent and that said Letters Patent is hereby corrected as shown below:

In column 4, line 63, after "pressure" insert "tower";

In column 5, line 20, delete "as" first occurrence and insert therefor --are--;

In column 6, line 54, delete "tower." and insert therefor --tower).--;

In column 7, line 67, delete "furhter" and insert therefor --further--;

In column 9, line 43, delete "reactifying" and insert therefor --rectifying--;

In column 10, line 16, delete "of" after "portion" and insert therefor --to--;

UNITED STATES PATENT AND TRADEMARK OFFICE

CERTIFICATE OF CORRECTION

PATENT NO. : 4,372,765

DATED : February 8, 1983

INVENTOR(S) : SHOICHI TAMURA ET AL

It is certified that error appears in the above-identified patent and that said Letters Patent is hereby corrected as shown below:

In column 10, line 54, delete "reactifying" and insert therefor --rectifying--;

In column 10, line 63, delete "toward" and insert therefor --tower--;

In column 12, line 1, insert "first" before "evaporator".

Signed and Sealed this

*Twenty-sixth* Day of *July 1983*.

[SEAL]

*Attest:*

GERALD J. MOSSINGHOFF

*Attesting Officer*

*Commissioner of Patents and Trademarks*